US011378046B2

(12) United States Patent
Tsuda et al.

(10) Patent No.: US 11,378,046 B2
(45) Date of Patent: Jul. 5, 2022

(54) FUEL SUPPLY APPARATUS AND OUTBOARD MOTOR

(71) Applicants: Mitsubishi Electric Corporation, Tokyo (JP); YAMAHA HATSUDOKI KABUSHIKI KAISHA, Shizuoka (JP)

(72) Inventors: Atsushi Tsuda, Tokyo (JP); Minoru Takata, Tokyo (JP); Kenji Kubo, Tokyo (JP); Hideto Arai, Shizuoka (JP); Hisashi Machida, Shizuoka (JP)

(73) Assignees: Mitsubishi Electric Coporation, Tokyo (JP); YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 17/072,659

(22) Filed: Oct. 16, 2020

(65) Prior Publication Data

US 2021/0239079 A1 Aug. 5, 2021

(30) Foreign Application Priority Data

Jan. 31, 2020 (JP) ..... JP2020-014404

(51) Int. Cl.
*F02M 37/10* (2006.01)
*B63H 20/00* (2006.01)
(Continued)

(52) U.S. Cl.
CPC ..... *F02M 37/10* (2013.01); *B63B 17/0027* (2013.01); *B63H 20/00* (2013.01); *F02M 2037/082* (2013.01)

(58) Field of Classification Search
CPC ..... F02M 37/10; F02M 2037/082; B63B 17/0027; B63H 20/00
See application file for complete search history.

(56) References Cited

U.S. PATENT DOCUMENTS 4,694,857 A * 9/1987 Harris ..... F02M 37/106 137/565.24
5,520,547 A 5/1996 Hamaoka et al.
(Continued)

FOREIGN PATENT DOCUMENTS

JP 08312485 A * 11/1996 ..... F02M 37/20
JP 3521449 B2 4/2004
(Continued)

*Primary Examiner* — Stephen P Avila
(74) *Attorney, Agent, or Firm* — Sughrue Mion, PLLC; Richard C. Turner

(57) ABSTRACT

A fuel supply apparatus mounted in a fuel tank has a fuel pump portion for sucking a fuel stored in the fuel tank and then discharging the fuel to the outside. The fuel supply apparatus includes a harness that is connected with an external power source; a power-sending connector portion a power-sending connector portion that is provided in a harness and has power-sending terminals having respective spring portions, a power-receiving connector portion that is provided in a fuel pump portion and has power-receiving terminals to be connected with the power-sending terminals, respectively, when contact pressure based on elastic force of the spring portions, as elastic portions, is provided thereto, and an insulator that covers at least base portions of the power-receiving terminals and at least parts of the spring portions of the power-sending terminals when the power-receiving terminals are connected with the power-sending terminals.

4 Claims, 2 Drawing Sheets

(51) Int. Cl.
*B63B 17/00* (2006.01)
*F02M 37/08* (2006.01)

(56) References Cited

U.S. PATENT DOCUMENTS

| | | | | |
|---|---|---|---|---|
| 6,390,683 | B1 * | 5/2002 | Hirose | F16C 35/073<br>384/277 |
| 2011/0053398 | A1 * | 3/2011 | Arai | H01R 13/521<br>439/271 |

FOREIGN PATENT DOCUMENTS

| | | | | |
|---|---|---|---|---|
| JP | 2005-133108 | A | 5/2005 | |
| JP | 2009-302039 | A | 12/2009 | |
| WO | WO-2019111630 | A1 * | 6/2019 | F02M 37/007 |

* cited by examiner

FUEL SUPPLY APPARATUS AND OUTBOARD MOTOR

BACKGROUND OF THE INVENTION

Field of the Invention

The present disclosure relates to a fuel supply apparatus and an outboard motor.

Description of the Related Art

As is well known, an in-tank fuel supply apparatus is configured in such a way as to be disposed in a fuel tank for storing fuel and to supply the fuel in the fuel tank to the outside. The in-tank fuel supply apparatus is driven in a state of being immersed in the fuel in the fuel tank; however, depending on a usage environment, a great deal of foreign matter such as water or dust may intrude in the fuel tank. In particular, in an outboard motor to be mounted in a vessel, due to oil supply on the sea, usage of inferior fuel, usage of fuel in an environment where dew condensation is generated on a fuel tank, or the like, the probability that foreign matter such as water or dust intrudes in the fuel tank becomes high. In this case, there exists a probability that foreign matter such as water or dust remains in a power-receiving connector portion of a fuel supply apparatus immersed in an in-tank fuel, thereby corroding power-receiving terminals provided in the power-receiving connector portion.

In order to solve the foregoing defect, there has been proposed an in-tank fuel supply apparatus (for example, refer to Japanese Patent Publication No. 3521449) in which a liquid discharge outlet is provided under a power-receiving connector portion. In the conventional in-tank fuel supply apparatus disclosed in Patent Document 1, when the power-receiving connector portion is exposed from the fuel, most of foreign matter such as water or dust in the power-receiving connector portion is discharged to the outside of the power-receiving connector portion through the liquid discharge outlet provided under the power-receiving connector portion.

PRIOR ART REFERENCE

Patent Document

[Patent Document 1] Japanese Patent No. 3521449

SUMMARY OF THE INVENTION

In general, in the power-receiving connector portion of a fuel supply apparatus, the power-receiving terminals and a resin are integrally insertion-molded; however, a small gap may be formed between the resin and the base of the power-receiving terminal. In the conventional fuel supply apparatus disclosed in Patent Document 1, the foregoing gap may exist at a position lower than that of the liquid discharge outlet; thus, because foreign matter such as water or dust intruding in the gap is not discharged through the liquid discharge outlet, the power-receiving terminal cannot sufficiently be prevented from corroding.

In addition, the fuel supply apparatus has a power-sending connector portion provided in a harness to be connected with an external power source; power-sending terminals provided in the power-sending connector portion have respective spring portions. The power-sending terminal is configured in such a way as to be electrically and mechanically connected with the power-receiving terminal, while maintaining a contact pressure, caused by expansion stress of the spring portion, on the power-receiving terminal. However, there exists a probability that a corrosive gas generated in the fuel including the foregoing foreign matter corrodes the power-sending terminal that keeps generating tensile stress and hence a connection failure occurs between the power-receiving terminal and the power-sending terminal.

The present disclosure is to disclose a technology for solving the foregoing problems; the objective thereof is to provide a fuel supply apparatus and an outboard motor that can prevent the power-receiving terminal and the power-sending terminal from corroding.

A fuel supply apparatus disclosed in the present disclosure is mounted in a fuel tank and has a fuel pump portion for sucking a fuel stored in the fuel tank and then discharging the fuel to the outside. The fuel supply apparatus is characterized by including a harness that is connected with an external power source, a power-sending connector portion that is provided in the harness and has a power-sending terminal having an elastic portion, a power-receiving connector portion that is provided in the fuel pump portion and has a power-receiving terminal to be connected with the power-sending terminal when contact pressure based on elastic force of the elastic portion is provided thereto, and an insulator that is disposed in such away as to cover at least a base portion of the power-receiving terminal and at least part of the elastic portion of the power-sending terminal when the power-sending terminal is connected with the power-receiving terminal.

An outboard motor disclosed in the present disclosure is equipped with a fuel supply apparatus that is mounted in a fuel tank and has a fuel pump portion for sucking a fuel stored in the fuel tank and then discharging the fuel to the outside. The outboard motor is characterized in that the fuel supply apparatus includes a harness that is connected with an external power source, a power-sending connector portion that is provided in the harness and has a power-sending terminal having an elastic portion, a power-receiving connector portion that is provided in the fuel pump portion and has a power-receiving terminal to be connected with the power-sending terminal when contact pressure based on elastic force of the elastic portion is provided thereto, and an insulator that is disposed in such away as to cover at least a base portion of the power-receiving terminal and at least part of the elastic portion of the power-sending terminal when the power-sending terminal is connected with the power-receiving terminal.

In the fuel supply apparatus disclosed in the present disclosure, corrosion of the power-receiving terminal and the power-sending terminal can be prevented.

In the outboard motor disclosed in the present disclosure, corrosion of the power-receiving terminal and the power-sending terminal in the fuel supply apparatus can be prevented.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
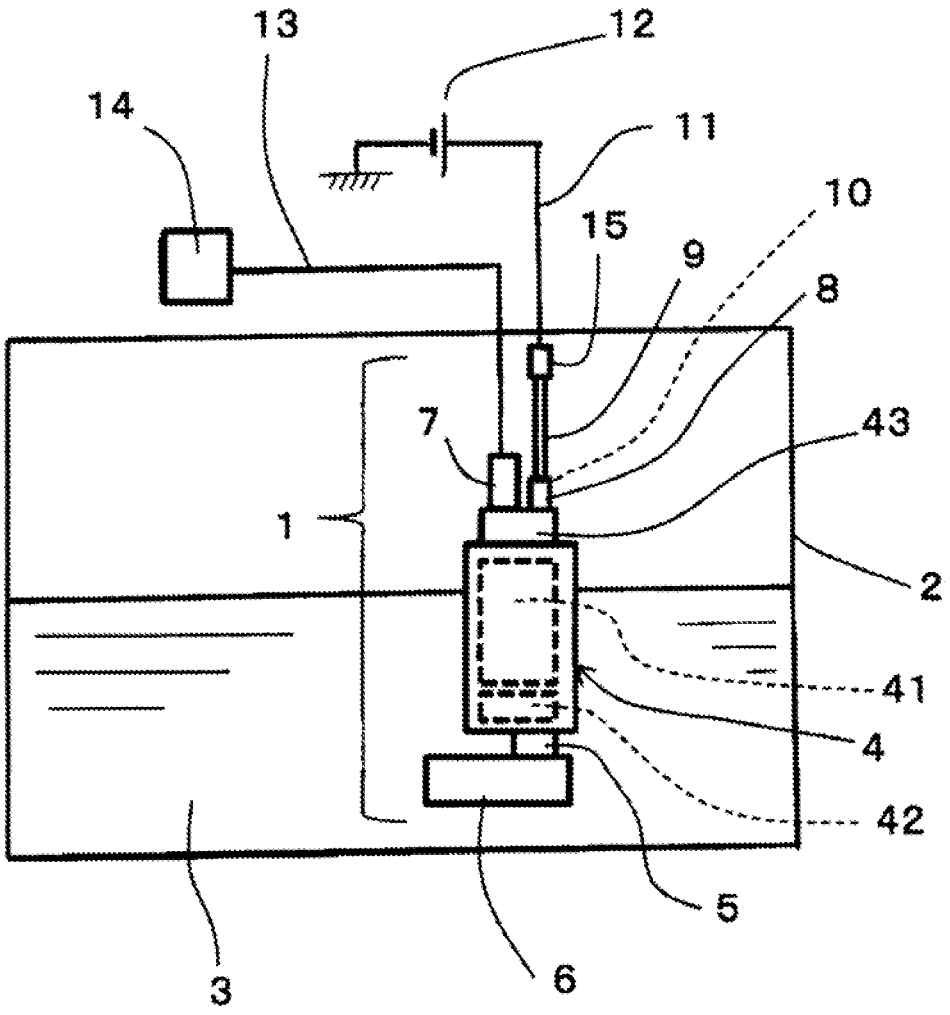
FIG. 1 is a schematic cross-sectional view illustrating a fuel supply apparatus, provided in a fuel tank, according to Embodiment 1.

Hereinafter, a fuel supply apparatus according to Embodiment 1 will be explained with reference to the drawings. FIG. 1 is a schematic cross-sectional view illustrating a fuel supply apparatus, provided in a fuel tank, according to Embodiment 1. In FIG. 1, a fuel supply apparatus 1 is mounted in the fuel tank 2 in such a way as to be suspended therein and is disposed in a state of being immersed in a fuel 3 stored in the fuel tank 2. In FIG. 1, the fuel tank 2 is not filled up with the fuel 3 stored therein and hence part of the fuel supply apparatus 1 is exposed from the liquid surface of the fuel 3; however, when the fuel tank 2 is filled up with the fuel 3, the fuel supply apparatus 1 is submerged in the fuel 3.

The fuel supply apparatus 1 is provided with a fuel pump portion 4, an intake pipe 5 provided at one axle-direction end portion of the fuel pump portion 4, an intake filter 6 attached to the intake pipe 5, a discharge pipe 7 provided in a wall portion 43 at the other axle-direction end portion of the fuel pump portion 4, a power-receiving connector portion 8 provided in the wall portion 43 of the fuel pump portion 4, a harness 9, and a power-sending connector portion 10 provided at one end portion of the harness 9. In FIG. 1, because inserted into the power-receiving connector portion 8, the power-sending connector portion 10 is not illustrated. The harness 9 is connected with a battery 12, as an external power source, through the intermediary of a power source cable 11 connected therewith by a power-source side connecter portion 15.

The fuel pump portion 4 is configured in such a way as to have a motor 41 and an impeller 42 to be driven by the motor 41, in the housing thereof, to make the motor 41 rotate the impeller 42 so as to suck the fuel 3 through the intake pipe 5 by way of the intake filter 6, and to apply a pressure on the sucked fuel so as to discharge the fuel through the discharge pipe 7.

In the fuel supply apparatus 1 configured in such a manner as described above, the battery 12 supplies electric power to the motor 41 in the fuel pump 4, by way of the power source cable 11, the power-source side connecter portion 15, the harness 9, the power-sending connector portion 10, and the power-receiving connector portion 8, so that the motor 41 is driven. As a result, the impeller 42 rotates; the fuel 3 is sucked though the intake pipe 5 by way of the intake filter 6; a pressure is applied to the sucked fuel so as to discharge the fuel through the discharge pipe 7; then, the fuel is supplied to an external apparatus 14 such as an internal combustion engine through the intermediary of a fuel pipe 13.

Figure 2:
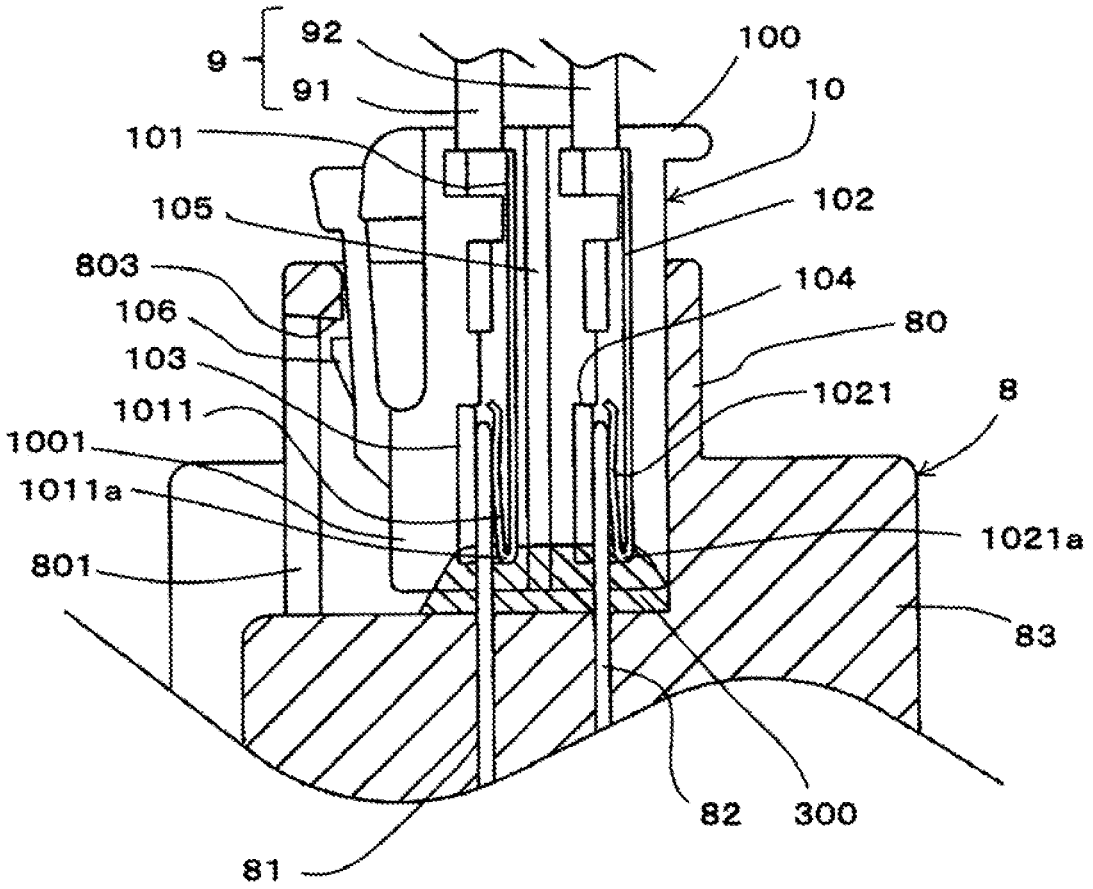
FIG. 2 is a schematic cross-sectional view of part of the fuel supply apparatus according to Embodiment 1.

Next, the power-receiving connector portion 8 and the power-sending connector portion 10 will be explained further in detail. FIG. 2 is a schematic cross-sectional view of part of the fuel supply apparatus according to Embodiment 1. In FIG. 2, the power-receiving connector portion 8 provided in the wall portion 43 (refer to FIG. 1) at the other axle-direction end portion of the fuel pump portion 4 has a receiving portion 80 that has an opening portion 801 at a side portion thereof and whose axle-direction end portion is opened. The receiving portion 80 is formed integrally with a main body portion 83 of the power-receiving connector portion 8. In the inner wall portion of the receiving portion 80, there is provided an engagement portion 803 that can engage with an engaging claw 106 provided on the outer wall portion of the power-sending connector portion 10, described later.

The power-receiving connector portion 8 has a positive-polarity power-receiving terminal 81 and a negative-polarity power-receiving terminal 82 that are connected with the motor 41 in the fuel pump portion 4. The positive-polarity power-receiving terminal 81 and the negative-polarity power-receiving terminal 82 are embedded in a resin included in the main body portion 83 of the power-receiving connector portion 8, through insertion-molding; in the inner space of the receiving portion 80, the respective front-end portions of the power-receiving terminals 81 and 82 are exposed and vertically protrude from the axel-direction endface portion of the main body portion 83. Here, the portion of each of the power-receiving terminals 81 and 82, from which the exposure thereof from the resin in the main body portion 83 starts, will be referred to as a base portion of the power-receiving terminal.

The power-sending connector portion 10 attached to the end portion of the harness 9 has a tubular and resin-made insertion portion 100 having an opening portion 1001 in a side portion thereof, a positive-polarity power-sending terminal 101, and a negative-polarity power-sending terminal 102. The positive-polarity power-sending terminal 101 and the negative-polarity power-sending terminal 102 are arranged inside the insertion portion 100 in such a way as to be separated from each other by a diaphragm portion 105 provided in the insertion portion 100. One end portion of the positive-polarity power-sending terminal 101 is joined to a positive-polarity terminal 91 of the harness 9, for example, through a crimping method; one end portion of the negative-polarity power-sending terminal 102 is joined to a negative-polarity terminal 92 of the harness 9, for example, through a crimping method. The other end portion of the positive-polarity power-sending terminal 101 has a spring portion 1011, as an elastic portion, that is formed in such a way as to be bent in a U-shape manner. The other end portion of the negative-polarity power-sending terminal 102 has a spring portion 1021, as an elastic portion, that is formed in such a way as to be bent in a U-shape manner.

As described above, the positive-polarity power-receiving terminal 81 and the negative-polarity power-receiving terminal 82 in the power-receiving connector portion 8 are arranged, through insertion-molding, in the main body portion 83 of the power-receiving connector portion 8; however, because the resin included in the main body portion 83 contracts, a small gap occurs between the main body portion 83 and the base portion of the power-receiving terminal 81, from which the power-receiving terminal 81 is exposed, or between the main body portion 83 and the base portion of the power-receiving terminal 82, from which the power-receiving terminal 82 is exposed. An insulator 300 is disposed on the axial-direction endface portion of the main body portion 83 in such a way as to fill a gap formed between the resin-made main body portion 83 and the base portion of the positive-polarity power-receiving terminal 81 and a gap formed between the resin-made main body portion 83 and the base portion of the negative-polarity power-receiving terminal 82.

As illustrated in FIG. 2, the insulator 300 is formed in such a way as to rise from the axial-direction endface portion of the main body portion 83 in the receiving portion 80 of the power-receiving connector portion 8; as described later, the insulator 300 is provided in such a way that when the power-sending connector portion 10 and the power-receiving connector portion 8 are coupled with each other, a bent portion 1011*a*, in which tensile stress in the spring portion 1011 of the positive-polarity power-sending terminal 101 occurs, and a bent portion 1021*a*, in which tensile stress in the spring portion 1021 of the negative-polarity power-sending terminal 102 occurs, are embedded in the insulator 300. It is desirable that the insulator 300 is a gel-like substance; for example, when as the insulator 300, insulating fluorine grease is utilized, the adhesiveness is raised.

In the fuel supply apparatus 1, configured in such a way as described above, according to Embodiment 1, the insertion portion 100 of the power-sending connector portion 10 in the harness 9 is inserted into the receiving portion 80 of the power-receiving connector portion 8, so that the fuel pump portion 4 and the harness 9 are electrically connected with each other. In this situation, the engaging claw 106 provided in the insertion portion 100 of the power-sending connector portion 10 fits with the engagement portion 803 of the power-receiving connector portion 8, so that the insertion portion 100 of the power-sending connector portion 10 is prevented from coming out from the receiving portion 80 of the power-receiving connector portion 8.

When the insertion portion 100 of the power-sending connector portion 10 is inserted into the receiving portion 80 of the power-receiving connector portion 8, the positive-polarity power-receiving terminal 81 is put between a holding wall 103 provided in the insertion portion 100 of the power-sending connector portion 10 and the spring portion 1011 of the positive-polarity power-sending terminal 101, and contact pressure caused by the elastic force of the spring portion 1011 is applied to the positive-polarity power-receiving terminal 8; as a result, the positive-polarity power-receiving terminal 81 is electrically connected with the positive-polarity power-sending terminal 101. Similarly, the negative-polarity power-receiving terminal 82 is put between a holding wall 104 provided in the insertion portion 100 of the power-sending connector portion 10 and the spring portion 1021 of the negative-polarity power-sending terminal 102, and contact pressure caused by the elastic force of the spring portion 1021 is applied to the negative-polarity power-receiving terminal 82; as a result, the negative-polarity power-receiving terminal 82 is electrically connected with the negative-polarity power-sending terminal 102.

When the insertion portion 100 of the power-sending connector portion 10 is inserted into the receiving portion 80 of the power-receiving connector portion 8 and hence the state illustrated in FIG. 2 is established, the bent portion 1011*a*, in which tensile stress in the spring portion 1011 of the positive-polarity power-sending terminal 101 occurs, and the bent portion 1021*a*, in which tensile stress in the spring portion 1021 of the negative-polarity power-sending terminal 102 occurs, are embedded in the insulator 300.

When the fuel supply apparatus 1 is submerged in the fuel 3 in the fuel tank 2, the fuel 3 intrudes into the power-receiving connector portion 8 and the power-sending connector portion 10; however, in the case where the power-receiving connector portion 8 and the power-sending connector portion 10 are exposed from the fuel 3, the fuel 3 that has intruded into the power-receiving connector portion 8 and the power-sending connector portion 10 flows out through the opening portion 1001 of the insertion portion 100 in the power-sending connector portion 10, and the fuel that has intruded into the power-receiving connector portion 8 flows out through the opening portion 801 of the receiving portion 80. When the power-sending terminals 101 and 102 are connected with the power-receiving terminals 81 and 82, respectively, the base portions of the power-receiving terminals 81 and 82 and at least part of each of the spring portions 1011 and 1021 of the power-sending terminals are covered with the insulator 300; therefore, even when a small gap exists between the main body portion 83 and the base portion from which the power-receiving terminal 81 is exposed or between the main body portion 83 and the base portion from which the power-receiving terminal 82 is exposed, foreign matter such as water or dust can be prevented from intruding into the gap.

In the foregoing fuel supply apparatus 1 according to Embodiment 1, the respective base portions of the exposed portions of the power-receiving terminals 81 and 82 in the power-receiving connector portion 8 are covered with the insulator 300; therefore, even when a small gap exists between the main body portion 83 and the base portion from which the power-receiving terminal 81 is exposed or between the main body portion 83 and the base portion from which the power-receiving terminal 82 is exposed, the gap can be covered with the insulator 300, so that the probability that foreign matter such as water or dust remains in the gap is low and hence the power-receiving terminals 81 and 82 can be suppressed from corroding.

Moreover, in the fuel supply apparatus 1 according to Embodiment 1, when the power-sending terminals 101 and 102 are connected with the power-receiving terminals 81 and 82, respectively, the respective bent portions 1011*a* and 1021*a* in the spring portions 1011 and 1021 of the power-sending terminals 101 and 102 are covered with the insulator 300; therefore, the probability that a corrosive gas adheres to the bent portions 1011*a* and 1021*a* becomes low and hence it is made possible to suppress stress corrosion cracking in the power-sending terminals.

Embodiment 2

Figure 3:
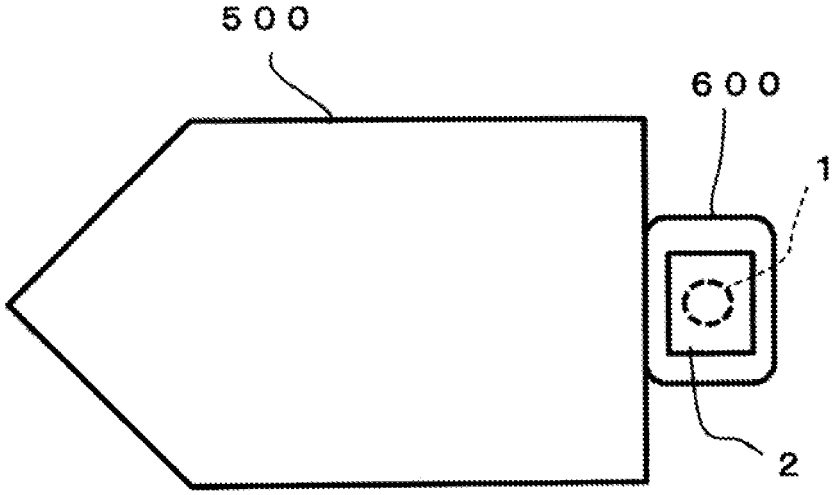
FIG. 3 is a schematic view of a vessel equipped with an outboard motor according to Embodiment 2.

Next, an outboard motor according to Embodiment 2 will be explained. FIG. 3 is a schematic view of a vessel equipped with an outboard motor according to Embodiment 2. In FIG. 3, an outboard motor 600 is attached to the rear portion of a vessel 500. The outboard motor 600 has an internal combustion engine (unillustrated), a screw (unillustrated) that is driven by the internal combustion engine so as to generate propulsion force, the fuel tank 2, and the fuel supply apparatus 1 that is submerged in a fuel stored inside the fuel tank 2. The fuel supply apparatus 1 has a configuration the same as that of the fuel supply apparatus 1 according to foregoing Embodiment 1.

In the outboard motor 600 according to foregoing Embodiment 2, the respective base portions of the exposed portions of the power-receiving terminals 81 and 82 in the power-receiving connector portion 8 are covered with the insulator 300; therefore, even when a small gap exists between the main body portion 83 and the base portion from which the power-receiving terminal 81 is exposed or between the main body portion 83 and the base portion from which the power-receiving terminal 82 is exposed, the gap can be covered with the insulator 300, so that the probability that foreign matter such as water or dust remains in the gap is low and hence the power-receiving terminals 81 and 82 can be suppressed from corroding. Accordingly, it is made possible to obtain the outboard motor 600 in which no defect occurs in the fuel supply apparatus 1.

Moreover, in the outboard motor 600 according to Embodiment 2, when in the fuel supply apparatus 1, the power-sending terminals 101 and 102 are connected with the power-receiving terminals 81 and 82, respectively, the respective bent portions 1011*a* and 1021*a* in the spring portions 1011 and 1021 of the power-sending terminals 101 and 102 are covered with the insulator 300; therefore, the probability that a corrosive gas adheres to the bent portions 1011*a* and 1021*a* becomes low and hence it is made possible to suppress stress corrosion cracking in the power-sending terminals. Accordingly, it is made possible to obtain the outboard motor 600 in which no defect occurs in the fuel supply apparatus 1.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations to one or more of the embodiments of the disclosure. It is therefore understood that numerous modifications which have not been exemplified can be devised without departing from the scope of the present disclosure. For example, at least one of the constituent components may be modified, added, or eliminated. At least one of the constituent components mentioned in at least one of the preferred embodiments may be selected and combined with the constituent components mentioned in another preferred embodiment.

What is claimed is:

1. A fuel supply apparatus that is mounted in a fuel tank and has a fuel pump portion for sucking a fuel stored in the fuel tank and then discharging the fuel to the outside, the fuel supply apparatus comprising:

a harness that is connected with an external power source;

a power-sending connector portion that is provided in the harness and has a power-sending terminal having an elastic portion;

a power-receiving connector portion that is provided in the fuel pump portion and has a power-receiving terminal to be connected with the power-sending terminal when contact pressure based on elastic force of the elastic portion is provided thereto; and an insulator that is disposed in such away as to cover at least a base portion of the power-receiving terminal and at least part of the elastic portion of the power-sending terminal when the power-sending terminal is connected with the power-receiving terminal.

2. The fuel supply apparatus according to claim 1, wherein the insulator is made of insulating fluorine grease.

3. An outboard motor equipped with a fuel supply apparatus that is mounted in a fuel tank and has a fuel pump portion for sucking a fuel stored in the fuel tank and then discharging the fuel to the outside, wherein the fuel supply apparatus has a harness that is connected with an external power source, a power-sending connector portion that is provided in the harness and has a power-sending terminal having an elastic portion, a power-receiving connector portion that is provided in the fuel pump portion and has a power-receiving terminal to be connected with the power-sending terminal when contact pressure based on elastic force of the elastic portion is provided thereto, and an insulator that is disposed in such away as to cover at least a base portion of the power-receiving terminal and at least part of the elastic portion of the power-sending terminal when the power-sending terminal is connected with the power-receiving terminal.

4. The outboard motor according to claim 3, wherein the insulator is made of insulating fluorine grease.

* * * * *